US011408405B2

(12) United States Patent
Dalton et al.

(10) Patent No.: US 11,408,405 B2
(45) Date of Patent: Aug. 9, 2022

(54) ELECTROMAGNETIC PUMP

(71) Applicant: University of Limerick, Limerick (IE)

(72) Inventors: Eric Dalton, Limerick (IE); Jeff Punch, Limerick (IE)

(73) Assignee: UNIVERSITY OF LIMERICK, Limerick (IE)

( * ) Notice: Subject to any disclaimer, the term of this patent is extended or adjusted under 35 U.S.C. 154(b) by 341 days.

(21) Appl. No.: 16/487,989

(22) PCT Filed: Mar. 29, 2018

(86) PCT No.: PCT/EP2018/058172
§ 371 (c)(1),
(2) Date: Aug. 22, 2019

(87) PCT Pub. No.: WO2018/185005
PCT Pub. Date: Oct. 11, 2018

(65) Prior Publication Data

US 2020/0025188 A1 Jan. 23, 2020

(30) Foreign Application Priority Data

Apr. 4, 2017 (GB) ..... 1705431

(51) Int. Cl.
*F04B 17/04* (2006.01)
*F04B 19/00* (2006.01)
(Continued)

(52) U.S. Cl.
CPC ..... *F04B 17/046* (2013.01); *F04B 19/006* (2013.01); *F02M 37/08* (2013.01);
(Continued)

(58) Field of Classification Search
CPC .... F04B 17/046; F04B 19/006; F04B 35/045; F04B 53/1082; F04B 53/126; F04B 53/14; F02M 37/08
(Continued)

(56) References Cited

U.S. PATENT DOCUMENTS 2,761,392 A * 9/1956 Parker ..... H02K 33/12 417/550
3,384,021 A * 5/1968 Perron ..... F04B 17/046 417/366
(Continued)

FOREIGN PATENT DOCUMENTS

DE 3132897 A1 8/1981
EP 0 605 903 A1 7/1994
(Continued)

OTHER PUBLICATIONS

International Search Report and Written Opinion for International Application No. PCT/EP2018/058172, entitled "Electromagnetic Pump," consisting of 4 pages, dated May 22, 2018.
(Continued)

*Primary Examiner* — Patrick Hamo
(74) *Attorney, Agent, or Firm* — Hamilton, Brook, Smith & Reynolds, P.C.

(57) ABSTRACT

An electromagnetic pump (100). The electromagnetic pump (100) comprises a conduit (101) comprising an inlet (103) and an outlet (105). A first magnetic field generating unit (109) is provided for generating a first magnetic field having a first component with a first direction in the conduit. A second magnetic field generating unit (111) is provided for generating a second magnetic field having a second component with a second direction in the conduit (101), the second direction being substantially opposite to the first direction. A piston member (113) is disposed within the conduit, the piston member (113) being moveable within the
(Continued)

conduit (101) under the influence of the first and/or second magnetic fields to pump fluid received from the inlet (103) of the conduit (101) to the outlet (105) of the conduit (101).

13 Claims, 8 Drawing Sheets

(51) Int. Cl.

| | |
|---|---|
| ***F02M 37/08*** | (2006.01) |
| *F04B 35/04* | (2006.01) |
| *F04B 53/10* | (2006.01) |
| *F04B 53/12* | (2006.01) |
| *F04B 53/14* | (2006.01) |

(52) U.S. Cl.
CPC ..... *F04B 35/045* (2013.01); *F04B 53/1082* (2013.01); *F04B 53/126* (2013.01); *F04B 53/14* (2013.01)

(58) Field of Classification Search
USPC ..... 417/415, 417
See application file for complete search history.

(56) References Cited

U.S. PATENT DOCUMENTS 3,836,289 A * 9/1974 Wolford ..... F04B 17/046 310/34
5,501,581 A * 3/1996 Han ..... F04B 17/046 417/415
5,662,461 A * 9/1997 Ono ..... H02K 33/04 417/418
5,713,728 A * 2/1998 Salamey ..... F04B 53/14 417/418
6,851,938 B2 * 2/2005 Ding ..... F04B 9/00 417/418
8,449,274 B1 * 5/2013 Zelechonok ..... F04B 17/04 417/419
9,028,227 B2 * 5/2015 Sardet ..... H02K 33/16 417/416
9,341,182 B2 * 5/2016 Mayoraz ..... F04B 53/125
2004/0219041 A1 11/2004 Rijnberg
2005/0063841 A1 1/2005 Iwamasa et al.
2011/0020143 A1 1/2011 Van Brunt

FOREIGN PATENT DOCUMENTS

GB 2 084 408 A 4/1982
WO WO2018185005 A1 10/2018

OTHER PUBLICATIONS

Great Britain Search Report for GB Patent Application GB1705431.3, entitled "Electromagnetic Pump," consisting of 4 pages, dated Sep. 12, 2017.

* cited by examiner

ELECTROMAGNETIC PUMP

This application is the U.S. National Stage of International Application No. PCT/EP2018/058172, filed Mar. 29, 2018, which designates the U.S., published in English, and claims priority under 35 U.S.C. § 119 or 365(c) to Great Britain Application No. 1705431.3, filed Apr. 4, 2017. The entire teachings of the above applications are incorporated herein by reference.

The present invention is directed towards electromagnetic pumps.

A known electromagnetic pump drives a piston between inlet and outlet ends of a conduit such that high pressure water can be delivered through the outlet. This kind of electromagnetic pump has found particular application in machines for making espresso coffee. In this known pump the conduit is surrounded by a coil. The piston is disposed within the conduit and the ends of the piston are operatively connected to helical return springs. The helical return springs are in turn connected to the inlet/outlet ends of the conduit. The helical return springs act to urge the piston away from the inlet/outlet ends of the conduit. The helical return spring for urging the piston towards the outlet is more powerful than the helical return spring for urging the piston towards the inlet such that in the absence of a magnetic field applied by the coil the piston is closer to the outlet than the inlet. The outlet of the conduit includes a ball valve mounted on a spring. The ball valve acts to selectively close an internal passageway in the piston.

In use an alternating voltage is applied to the coil. During the positive voltage half of a driving cycle, the coil is energized which drives the piston towards the inlet end of the conduit. As the ball valve does not block the passageway of the piston during this movement, water can flow through the piston towards the outlet of the conduit. During the negative voltage half of the cycle a diode arrangement provided with the coil prevents current from passing through the coil and so no magnetic field is generated. In the absence of a magnetic field, the inlet end helical return springs act to urge the piston towards the outlet end of the passageway and the ball valve acts to close the passageway through the piston. The movement of the piston creates a driving force which pumps water through the outlet at high pressure.

It is desirable to improve factors such as one or more of the pumping efficiency, power, volume, flow rate, pressure, cost and reliability of existing electromagnetic pumps, or at least provide an alternative to existing pumps.

It is further desirable to provide an electromagnetic pump suitable to act as a micropump for microfluidic applications.

According to the present invention there is provided an electromagnetic pump comprising: a conduit comprising an inlet and an outlet; a first magnetic field generating unit for generating a first magnetic field having a first component with a first direction in the conduit; a second magnetic field generating unit for generating a second magnetic field having a second component with a second direction in the conduit, the second direction being substantially opposite to the first direction; a piston member disposed within the conduit, the piston member being movable within the conduit under the influence of the first and/or second magnetic fields to pump fluid received from the inlet of the conduit to the outlet of the conduit.

Unlike the known electromagnetic pump arrangement which uses a single electromagnetic coil, the present invention provides a first magnetic field generating unit and a second magnetic field generating unit. Further, the first magnetic field generating unit is adapted to generate a first magnetic field having a first component in a first direction, and the second magnetic field generating unit is adapted to generate a second magnetic field having a second component in a second direction substantially opposite to the first direction. The first and second magnetic fields with components in substantially opposite directions can cooperate together to produce a greater magnetic flux for driving the piston member through the conduit than existing single coil driving arrangements.

The first and second magnetic field generating units may be adapted to be simultaneously driven to generate the first and second magnetic fields.

The first and second magnetic field generating units may be adapted to be driven under one or more alternating power cycles to periodically reverse the direction of the magnetic fields generated by the first and second magnetic field generating units.

Advantageously, the first and second magnetic fields are able to generate magnetic fields during the full power cycle. The first and second magnetic field generating units are able to reverse the direction of the magnetic fields generated. This means that the present invention is able to make efficient use of the full power cycle unlike the existing single coil driving arrangement.

During a first portion of the one or more alternating power cycles, the first and second magnetic field generating units may be adapted to direct the first component of the first magnetic field and the second component of the second magnetic field towards one another.

During a second portion of the one or more alternating power cycles, the first and second magnetic field generating units may be adapted direct the first component of the first magnetic field and the second component of the second magnetic field away from one another.

Advantageously, during the first portion of the one or more alternating power cycles, the piston member is able to be driven towards one end (i.e. the inlet or outlet) of the conduit. During the second portion of the one or more alternating power cycles, the piston member is able to be driven towards the other end of the conduit. Therefore, the alternating power cycles generate an oscillating movement of the piston member to produce a pumping action.

The first portion and/or the second portion of the one or more alternating cycles may be first and/or second halves of the one or more alternating power cycles.

The one or more alternating power cycles may comprise alternating voltage cycles. The alternating voltage cycles may have a positive portion of the cycle and a negative portion of the cycle.

The electromagnetic pump may further comprise a valve member. The valve member may be adapted to permit the flow of fluid from the inlet of the conduit to the outlet of the conduit and to restrict the flow of fluid from the outlet of the conduit to the inlet of the conduit.

The valve member may be adapted to move with the piston member through the conduit.

The valve member may be magnetic or magnetisable. Advantageously, the magnetic or magnetisable valve member is able to move with the piston member under the influence of the first and/or second magnetic field. As the alternating power cycle switches between the first half of the power cycle and the second half of the power cycle, the magnetic or magnetisable valve member is pulled from one end portion of the piston member to the other end portion of the piston member such that the valve member performs an automatic or self-sealing function.

The movement of the magnetic or magnetisable valve member within the conduit may cause or enhance the movement of the piston member within the conduit under the influence of the first and/or second magnetic field. The valve member may be magnetic or magnetisable and the piston member may comprise a non-magnetic or non-magnetisable material. Alternatively the valve member may be magnetic or magnetisable and the piston member may be magnetic or magnetisable. The magnetic or magnetisable material may comprise neodymium.

The piston member may comprise a passageway extending therethrough. The valve member may be adapted to selectively close the passageway through the piston member. The valve member may be adapted to open the passageway when the piston member moves towards the inlet of the conduit and may be adapted to close the passageway when the piston member moves towards the outlet of the conduit.

The valve member may be disposed at least partially within the passageway of the piston member. The valve member may be disposed entirely with the passageway of the piston member. The valve member may be movable or freely movable within the piston member. Advantageously, the present invention provides a simpler valve arrangement than the known pump outlined above by providing fewer components and avoiding the need for a helical spring to control the movement of the valve member. The valve member of the present invention is simpler and more reliable as there are fewer components which may be damaged or fail.

The piston member may comprise one or more obstructions within or surrounding the passageway. The one or more obstructions may be adapted to prevent the valve member from exiting the passageway. The one or more obstructions may be adapted to limit the length of passageway through which the valve member may move. Advantageously, the one or more obstructions limiting the length of passageway through which the valve member may move allows the electromagnetic pump to pump fluid at a higher frequency. This is because the valve member has to travel a shorter distance through the passageway during each alternating cycle.

The one or more obstructions may comprise a first obstruction provided towards one end portion of the piston member. The valve member may be adapted to cooperate with the first obstruction to selectively close the passageway through the piston member. The first obstruction may be a tapered or narrowing section of the passageway. The one or more obstructions may comprise a second obstruction provided towards the other end portion of the piston member. The second obstruction may comprise a stop member for limiting the length of passageway through which the valve member may move. The stop member may be disposed within the passageway and be arranged to prevent movement of the valve member past the stop member but allow the passage of fluid. The stop member may be in the form of an extending projection. The extending projection may extend along a part of the length of the passageway to limit the length of passageway through which the valve member may move. The extending projection may be constructed of a stiff material such as stainless steel or titanium. The extending projection may be in the form of a helix. The second obstruction may additionally or alternatively comprise a mesh material. In some embodiments, the mesh material may act as the stop member. In some embodiments, the mesh material may be connected to the extending projection. The mesh material may be an aluminum mesh.

The piston member may have a symmetric configuration. In the symmetric configuration, both ends of the piston member may comprise a first obstruction. The first obstruction may be in the form of a tapered or narrowing section of the passageway.

The valve member may be a non-magnetic material. An example of a non-magnetic material is zirconium.

The valve member may comprise a ball. The ball may be disposed within the piston member.

The electromagnetic pump may further comprise one or more biasing means for urging the piston member away from one or both of the inlet and the outlet of the conduit.

The one or more biasing means may be adapted to urge the piston member into an equilibrium position in the absence of the first and second magnetic fields being generated by the first and second magnetic field generating units.

The one or more biasing means may comprise a first biasing means for urging the piston member away from the inlet of the conduit and a second biasing means for urging the piston member away from the outlet of the conduit. The first biasing means and the second biasing means may be adapted to both generate an approximately equal force such that the equilibrium position is located at an approximately equal distance between the first biasing means and the second biasing means.

The one or more biasing means may be springs.

The one or more biasing means may comprise one or more magnetic members. The one or more magnetic members may be permanent magnets. The one or more magnetic members may be neodymium magnetics.

Advantageously, using one or more magnetic members for the biasing means simplifies the construction of the pump as fewer movable components are required. The magnetic members are more reliable than the helical springs used in the known electromagnetic pumps and are less prone to wear. In addition, helical springs are non-linear which means that they only generally provide sufficient biasing force when the piston member is at its extreme end positions under the alternating power cycle. The use of magnetic members as the biasing means avoids this problem.

The first magnetic field generating unit and the second magnetic field generating unit may be spaced apart from one another or abutting one another. Where the first and second magnetic field generating units are spaced apart from one another, the equilibrium position may include a region of the conduit between the first and second magnetic field generating units. Where the first and second magnetic field generating units abut one another, the equilibrium position may include a region of the conduit where the first and second magnetic field generating units abut.

The first magnetic field generating unit and the second magnetic field generating unit are proximate to one another. The first magnetic field generating unit may be close to our touching the second magnetic field generating unit or may be spaced apart by a relatively short distance. Advantageously, by having magnetic field generating units proximate to one another, a large magnetic flux is generated towards the end regions of the first and second magnetic field generating units. The first and second magnetic field generating units cooperate to generate this large magnetic flux and thus the piston member experiences a greater driving force.

The first magnetic field generating unit and the second magnetic field generating unit may be sufficiently proximate to one another that the first and second magnetic fields cooperate to generate a region of large magnetic flux between the first and second magnetic field generating units.

The first magnetic field generating unit and second magnetic field generating unit may be sufficiently proximate to one another that in the equilibrium position, the end portions of the piston member are proximate to the facing end portions of the first and second magnetic field generating units. Advantageously, this means that in the equilibrium position the piston will experience the maximum magnetic flux. The piston is therefore in the optimum position for maximum deflection and as a result the piston experiences a greater driving force.

The first magnetic field generating unit may comprise a first coil. The second magnetic field generating unit may comprise a second coil. The first coil may have windings disposed in a first winding direction. The second coil may have windings disposed in a second winding direction opposite or substantially opposite to the first winding direction. The first coil and/or the second coil may surround the conduit. The first and second coil may be driven by the same power source.

The first and/or second coils may surround the circumference of the conduit. The first and/or second coils may be constructed from copper.

The piston member may comprise a magnetic or magnetisable member. The piston member may comprise a permanent magnet. The piston member may comprise neodymium.

The conduit may be constructed from a non-magnetic material. An example of the non-magnetic material is non-magnetic stainless steel.

The electromagnetic pump may be a micropump. Advantageously, the electromagnetic pump of the present invention is able to act as a micropump for use in microfluidic applications.

The electromagnetic pump comprises an outer housing that surrounds the conduit. The outer housing may be constructed from a non-magnetic material. An example of the non-magnetic material is non-magnetic stainless steel. The outer housing may be constructed from a biocompatible material.

The electromagnetic pump may have a volume of between 1 $cm^3$ and 21 $cm^3$.

The electromagnetic pump may operate over a range of frequencies. The frequencies may range from 1 Hz to 120 Hz. The electromagnetic pump may operate over a range of input powers. The input powers may range from 0.1 W to 10 W.

According to the present invention there is further provided a method for pumping fluid through a conduit having a piston member disposed therein, the method comprising: driving a first magnetic field generating unit to generate a first magnetic field, the first magnetic field having a first component with a first direction in the conduit; driving a second magnetic field generating unit to generate a second magnetic field, the second magnetic field having a second component with a second direction in the conduit, the second direction being substantially opposite to the first direction, wherein the first and/or second magnetic fields move the piston member within the conduit to pump fluid through the conduit.

The method may comprise driving the first and second magnetic field generating units simultaneously to generate the first and second magnetic fields.

The method may comprise driving the first and second magnetic field generating units under one or more alternating power cycles to periodically reverse the direction of the magnetic fields generated by the first and second magnetic field generating units.

During a first portion of the one or more alternating power cycles, the first and second magnetic field generating units may direct the first component of the first magnetic field and the second component of the second magnetic field towards one another.

During a second portion of the one or more alternating power cycles, the first and second magnetic field generating units may direct the first component of the first magnetic field and the second component of the second magnetic field away from one another.

The first portion and/or the second portion of the one or more alternating cycles may be first and/or second halves of the one or more alternating power cycles.

The one or more alternating power cycles may comprise alternating voltage cycles. The alternating voltage cycles may have a positive portion of the cycle and a negative portion of the cycle.

The method may be performed using the electromagnetic pump as described above.

Various combinations of optional features have been described herein, and it will be appreciated that described features may be combined in any suitable combination. In particular, the features of any one example embodiment may be combined with features of any other embodiment, as appropriate, except where such combinations are mutually exclusive. Throughout this specification, the term "comprising" or "comprises" means including the component(s) specified but not to the exclusion of the presence of others. Other features of the invention will be apparent from the dependent claims, and the description which follows.

For a better understanding of the invention, and to show how embodiments of the same may be carried into effect, reference will now be made, by way of example only, to the accompanying diagrammatic drawings in which.

Figure 3A:
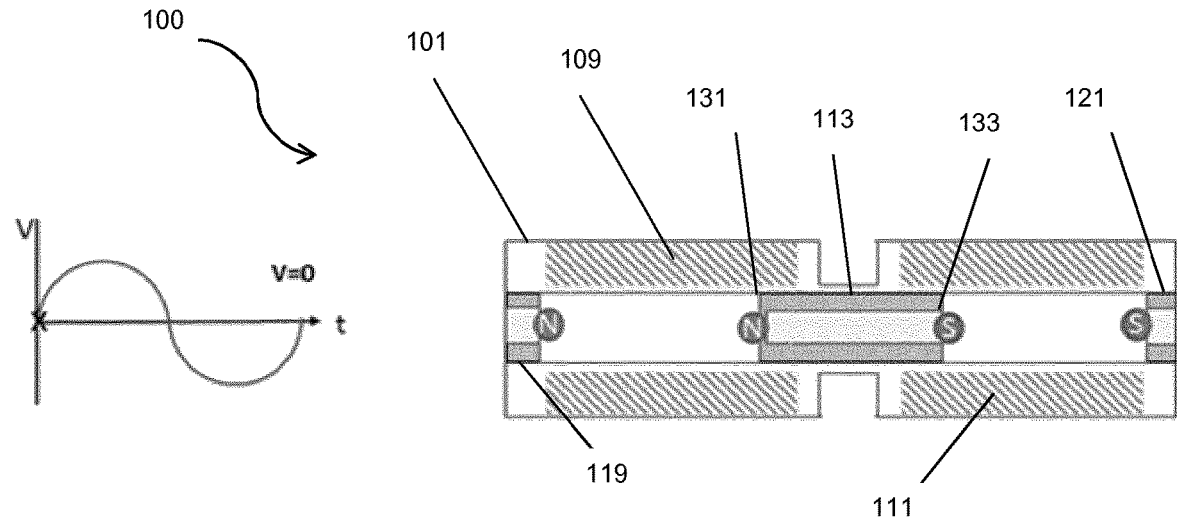
Figure 3B:
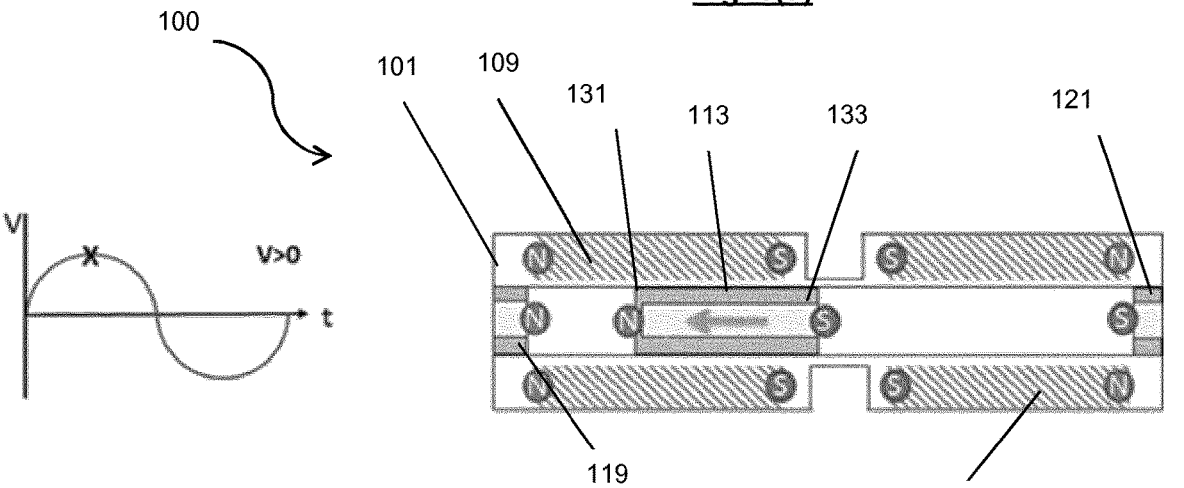
Figure 3C:
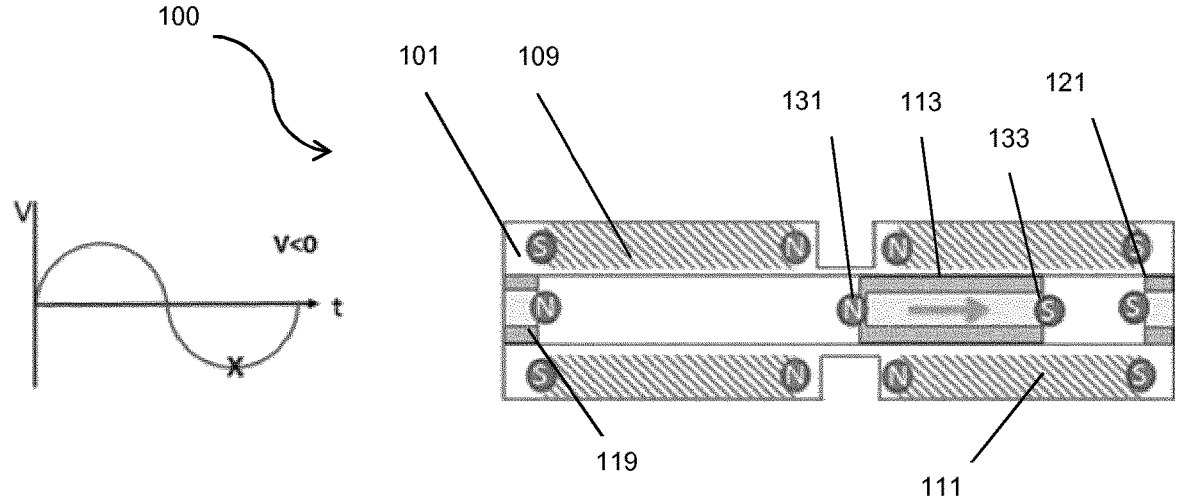
Figure 4:
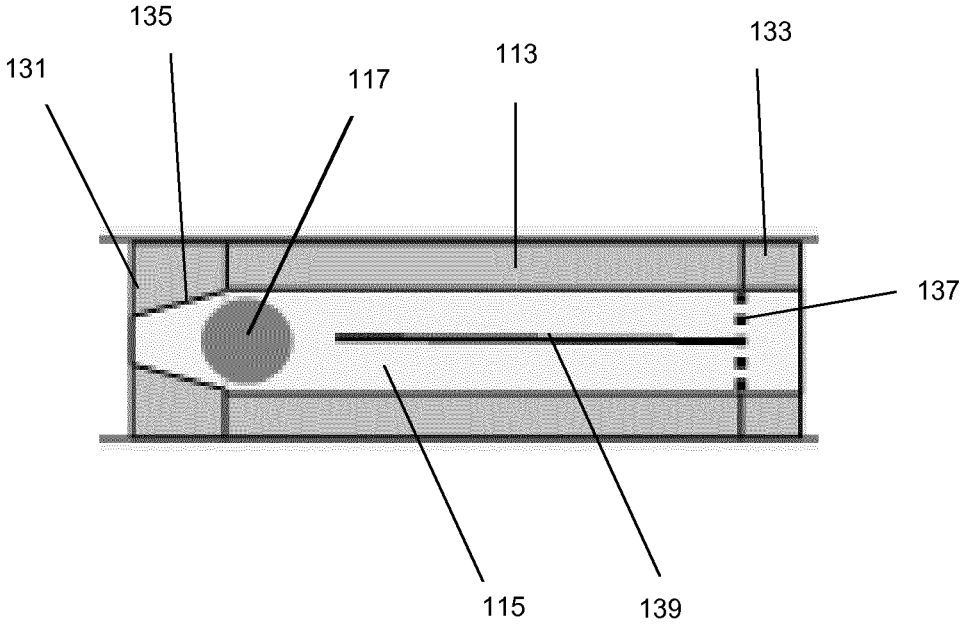
Figure 5A:
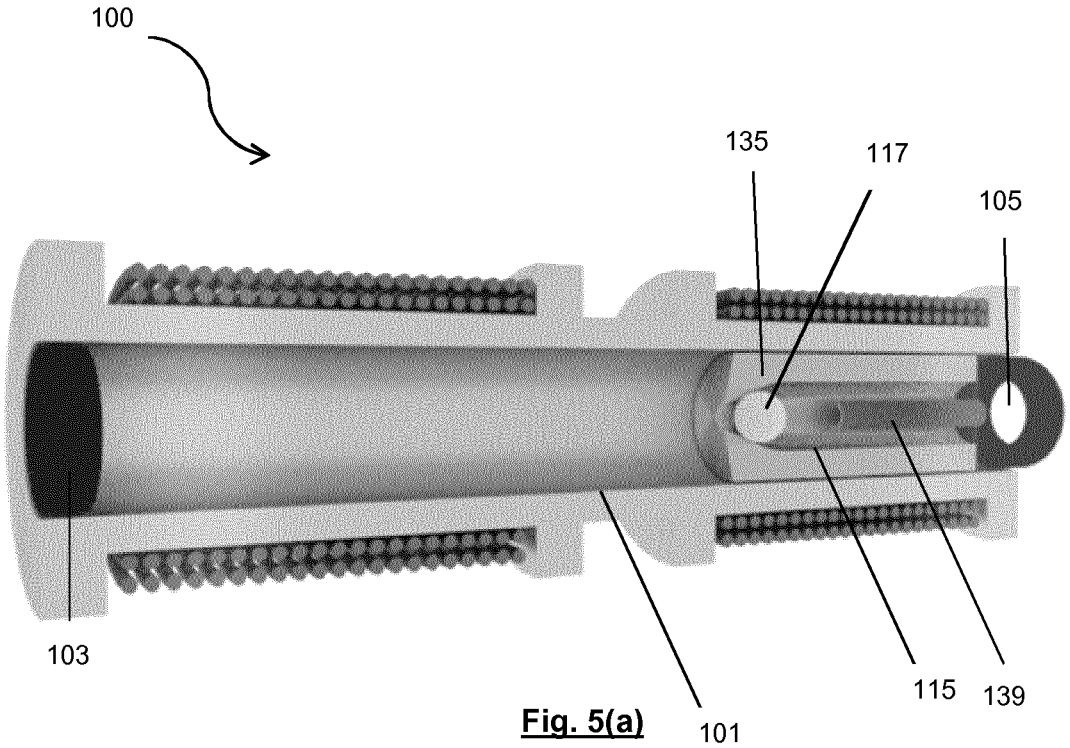
Figure 5B:
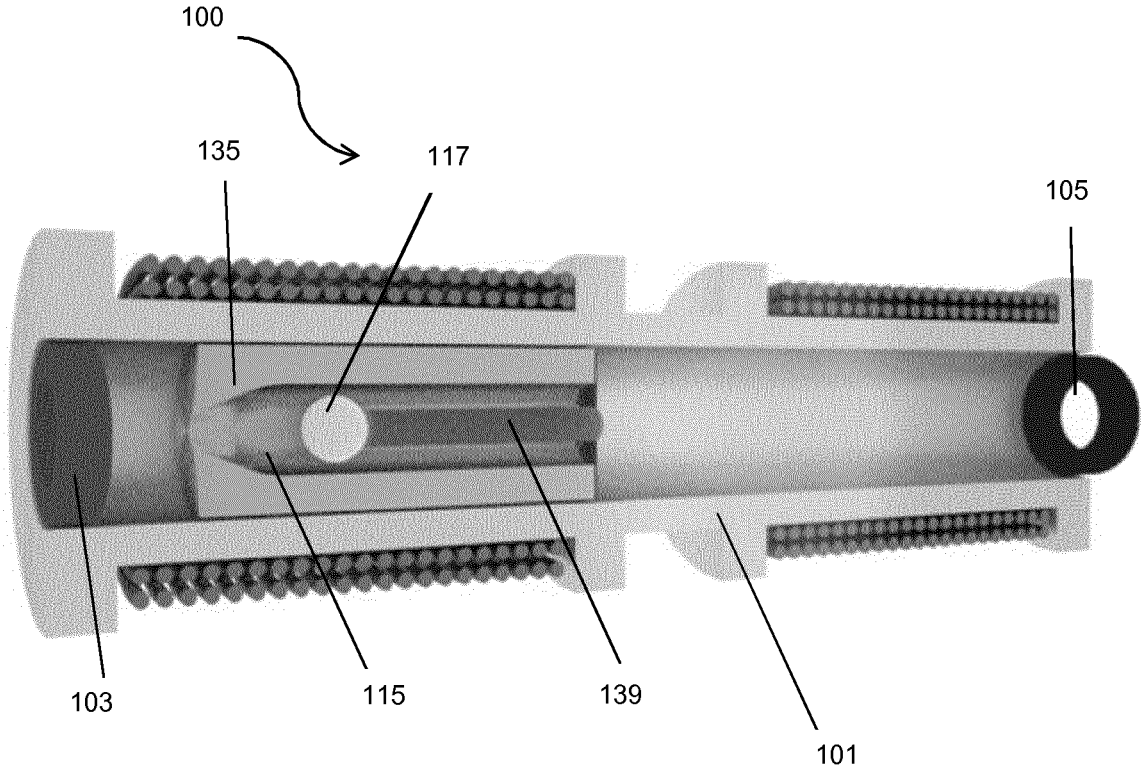
Figure 6:
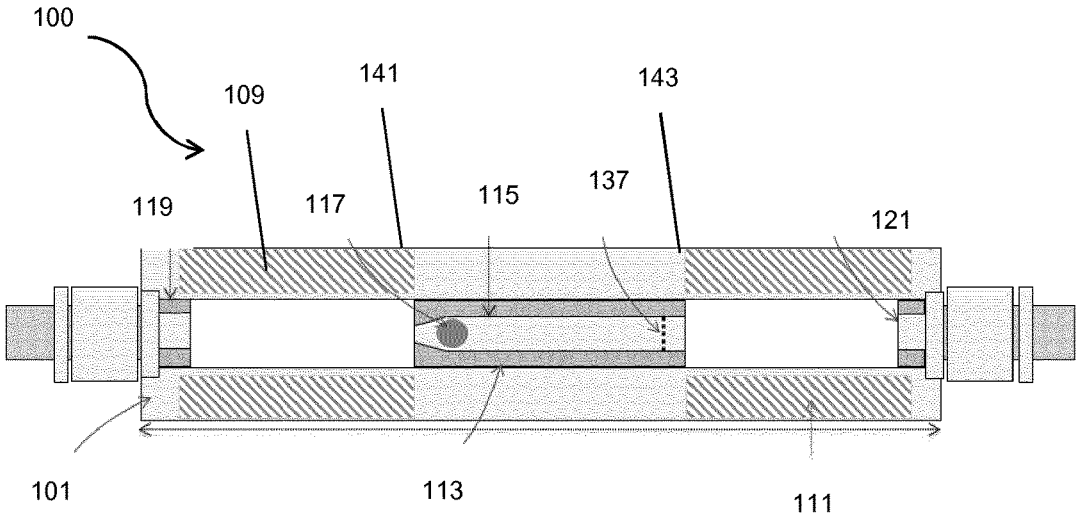
Figure 7:
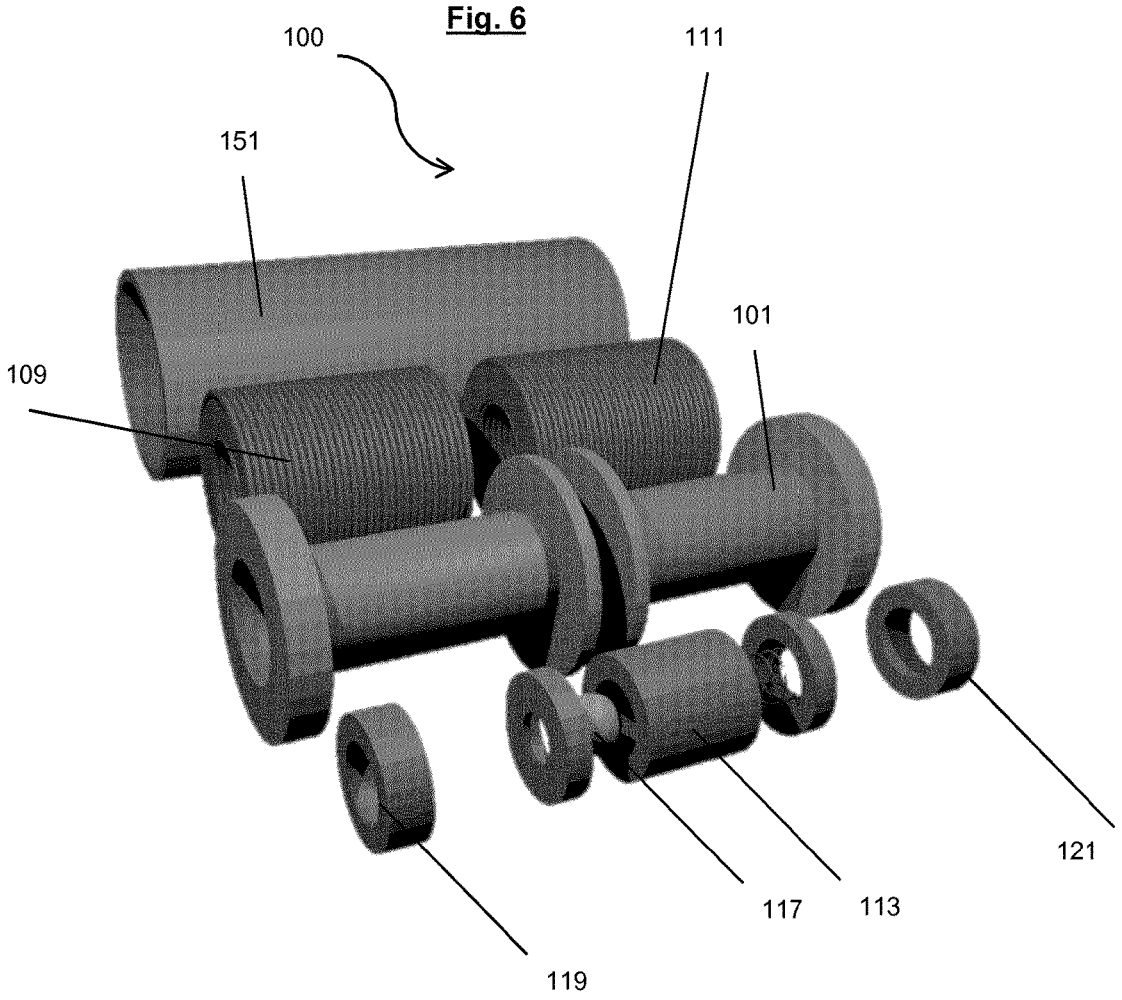
Figure 8A:
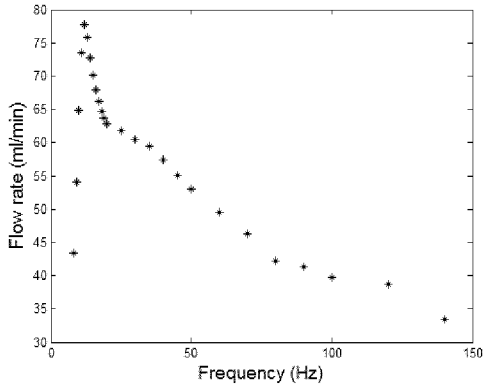
Figure 8B:
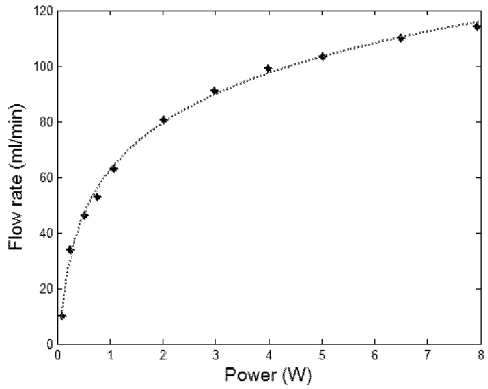
Figure 8C:
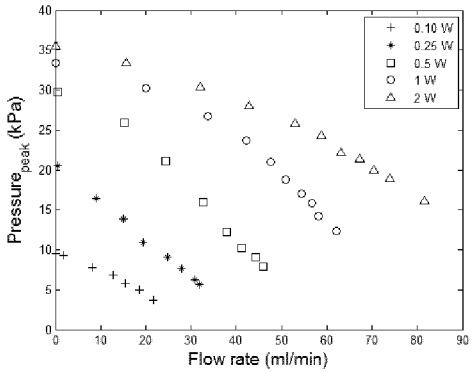
Figure 8D:
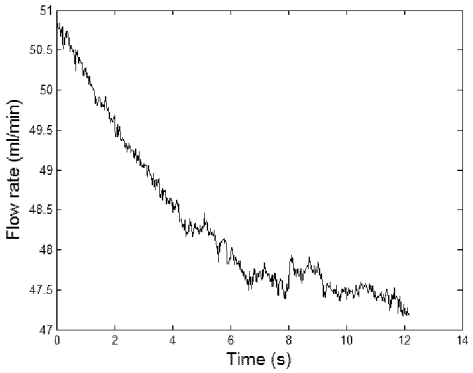
Figure 9:
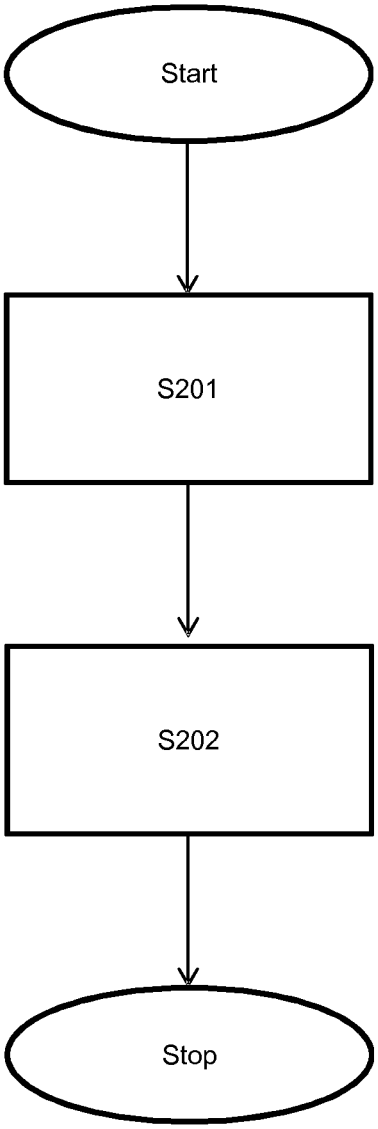
Figure 10:
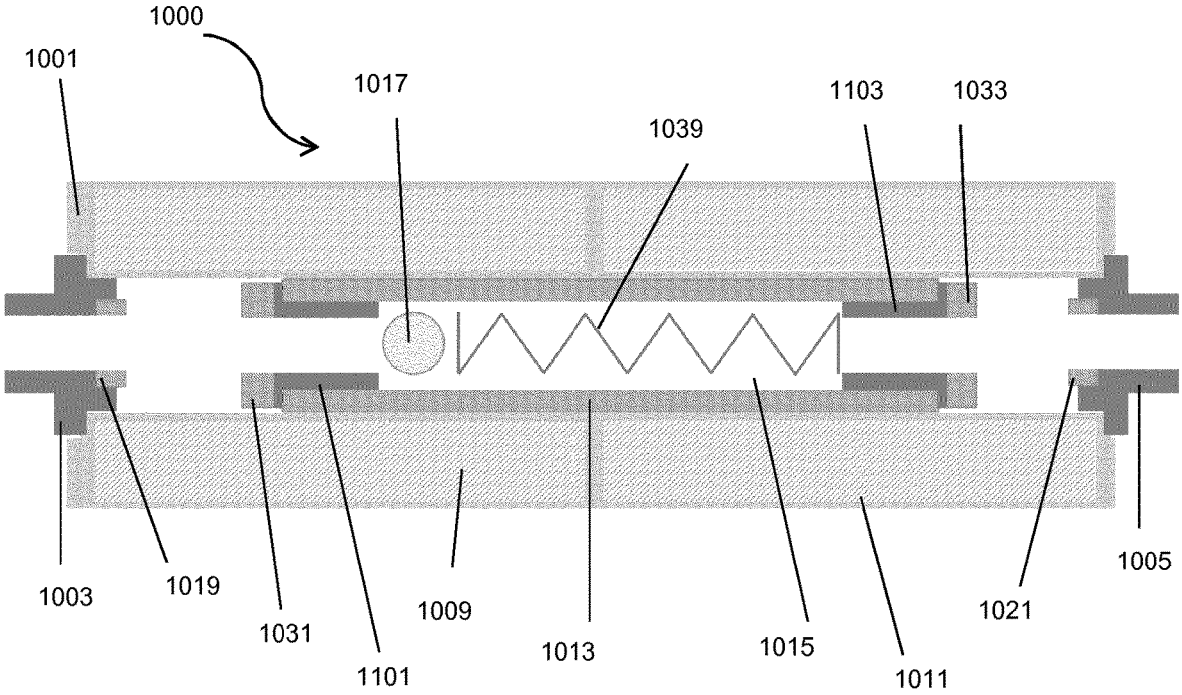
Figure 11A:
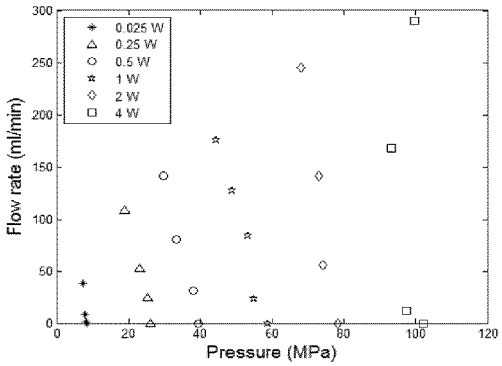
Figure 11B:
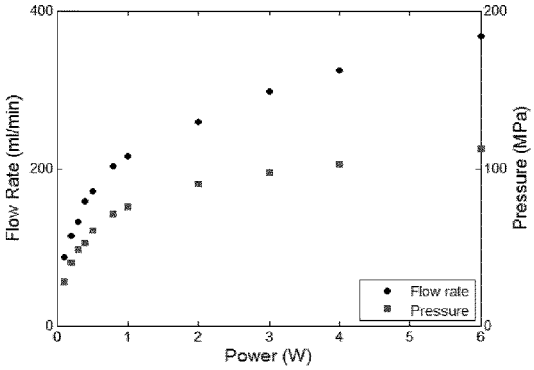

FIGS. 3*a*-3*c* are schematic diagrams of an electromagnetic pump according to an example embodiment showing the position of the piston member during an alternating power cycle;

FIG. 4 is a schematic diagram of the piston member of the electromagnetic pump according to an example embodiment;

FIG. 5*a* is a schematic diagram of an electromagnetic pump according to an example embodiment with the piston member in a first position;

FIG. 5*b* is a schematic diagram of the electromagnetic pump of FIG. 5*a* with the piston member in a second position; and FIG. 6 is a schematic diagram of an electromagnetic pump according to an example embodiment;

FIG. 7 is a schematic expanded diagram of an electromagnetic pump according to an example embodiment;

FIGS. 8(*a*)-8(*d*) are graphs outlining the pumping characteristics of an electromagnetic micropump according to an example embodiment;

FIG. 9 is a block diagram of a method of operating an electromagnetic pump according to an example embodiment;

FIG. 10 is a schematic diagram of an electromagnetic pump according to an example embodiment; and FIG. 11(*a*)-(*b*) are graphs outlining the pumping characteristics of an electromagnetic pump according to an example embodiment.

Figure 1:
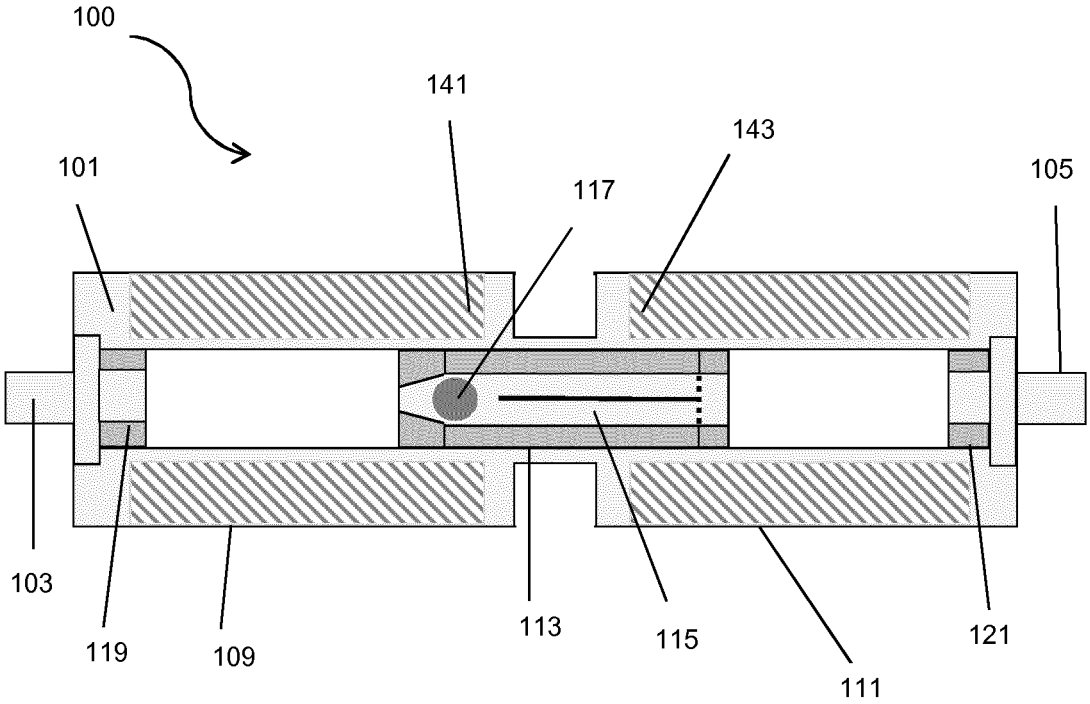
FIG. 1 is a schematic diagram of an electromagnetic pump according to an example embodiment.

Referring to FIG. 1 there is shown an electromagnetic pump indicated generally by the reference numeral 100. The electromagnetic pump 100 comprises a conduit 101. The conduit 101 shown is cylindrical with a circular internal cross-section although other shapes of conduit 101 and internal cross-section are within the scope of the present invention. The conduit 101 comprises an inlet 103 through which fluid may enter the conduit 101. The conduit 101 further comprises an outlet 105 through which fluid may exit the conduit 101.

The electromagnetic pump 100 is not limited to any particular form of fluid. Wide ranging fluids in terms of composition and fluidic properties, such as composition, can be used with the electromagnetic pump 100. By way of example, compatible fluids include water, sea water, oils and alcohols. Highly corrosive acidic fluids and magnetic fluids are generally not expected to be compatible with the electromagnetic pump 100 although the negative effect of these fluids may be mitigated to an extent through the appropriate selection of materials for the electromagnetic pump 100. The electromagnetic pump 100 comprises a first magnetic field generating unit 109 and a second magnetic field generating unit 111. The first magnetic field generating unit 109 is adapted to generate a first magnetic field having a first component with a first direction in the conduit 101. The first direction could be, for example, towards the outlet 105 or towards the inlet 103. The second magnetic field generating unit 111 is adapted to generate a second magnetic field having a second component with a second direction in the conduit 101. The second direction could be, for example, towards the outlet 105 or towards the inlet 103, but is substantially opposite to the first direction. This means, for example, that when the first direction is towards the outlet 105 the second direction is substantially towards the inlet 103.

The electromagnetic pump 100 comprises a piston member 113 disposed within the conduit 101. The piston member 113 is movable within the conduit 101 under the influence of the first and/or second magnetic fields to pump fluid received from the inlet 103 of the conduit to the outlet 105 of the conduit. In the example embodiment shown in FIG. 1, the piston member 113 comprises a magnetic or magnetisable member to enable the piston member 113 to move within the conduit 101 under the influence of the first and/or second magnetic fields. In other arrangements not expressly shown in the drawings, the piston member 113 may be non-magnetic but movable within the conduit 101 under the influence of the first and/or second magnetic fields due to the presence of another magnetic or magnetisable member which is operatively connected to the piston member 113. For example, a valve member 117 disposed within the passageway 115 of the piston member 113 and discussed in greater detail below may be magnetic or magnetisable and as a result may cause the movement of the piston member 113 under the influence of the first and/or second magnetic fields.

Figure 2:
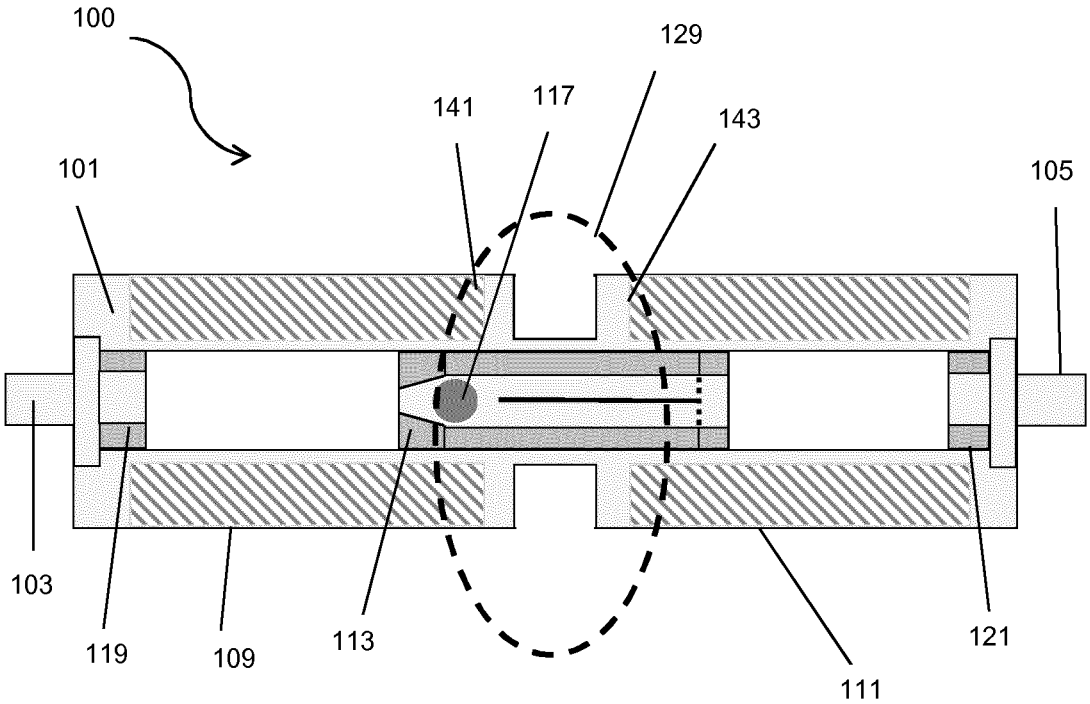
FIG. 2 is another schematic diagram of the electromagnetic pump shown in FIG. 1.

The present invention does not just provide an electromagnetic pump 100 with a first magnetic field generating unit 109 and a second magnetic field generating unit 111 as compared to the single driving coil of the known electromagnetic pump. Instead and counter intuitively, the inventors of the present invention realised that by providing the first magnetic field generating unit 109 to generate a first magnetic field having a first component in a first direction, and the second magnetic field 111 generating unit to generate a second magnetic field having a second component in a second direction substantially opposite to the first direction, a greater driving force for displacing the piston member 113 in the conduit 101 can be provided. In particular, the inventors realised that the maximum force produced by a magnetic field generating unit is at the region of maximum magnetic flux, which is provided at the ends of the magnetic field generating unit. Having the first and second magnetic field generating units 109, 111 with components in substantially opposite directions means that when the first and second magnetic field generating units 109, 11 are simultaneously driven, the magnetic flux generated by the first and second magnetic field generating units 109, 111 add together to thereby maximize the magnetic flux and thus the force generated. Therefore, within the region 129 as shown in FIG. 2 the piston member 113 experiences the maximum force of the first and second magnetic field generating units 109, 111 which act to pull the piston member 113 towards one of the inlet 103 and the outlet 105 of the conduit 101.

The first and second magnetic field generating units 109, 111 are driven under one or more alternating power cycles, such as one or more alternating voltage cycles. Therefore, unlike the prior art electromagnetic pump which only uses half of an alternating voltage cycle to drive the single coil, the electromagnetic pump 100 of the present invention is able to utilise the full alternating power cycle to drive the first and second magnetic field generating units 109, 111. The inclusion of the first and second magnetic field generating units 109, 111 which generate first and second magnetic fields with first and second components in substantially opposite directions therefore and significantly provides a more energy efficient electromagnetic pump 100 than the existing single coil pump arrangement. This is an additional and surprising advantage provided by the electromagnetic pump 100.

Being driven under one or more alternating power cycles means that the direction of the magnetic fields generated by the first and second magnetic field generating units 109, 111 periodically reverses. For example, during a first portion of the one or more alternating power cycles (e.g. when the applied voltage is greater than 0V), the first and second magnetic field generating units 109, 111 are adapted to direct the first component of the first magnetic field and the second component of the second magnetic field towards one another. Referring to FIG. 2, this means that the first and second components are directed towards the region 129. The first and second magnetic fields cooperate to create a driving force to drive the piston member 113 towards either the inlet 103 or the outlet 105 of the conduit 101. During a second portion of the one or more alternating power cycles (e.g. when the applied voltage is less than 0V), the first and second magnetic field generating units 109, 111 are adapted direct the first component of the first magnetic field and the second component of the second magnetic field away from one another. Referring to FIG. 2, this means that the first and second components are directed away form the region 129. The first and second magnetic fields cooperate to create a driving force to drive the piston member 113 in the opposite direction than during the first portion of the one or more alternating power cycles. This means that the alternating power cycles generate an oscillating movement of the piston member 113 to produce a pumping action.

Referring to FIG. 1, the electromagnetic pump 100 further comprises one or more biasing members 119, 121 for urging the piston member 113 away from one or both of the inlet 103 and outlet 105 of the conduit 101. In particular, the electromagnetic pump 100 of FIG. 1 comprises a first biasing member 119 for urging the piston member 113 away from the inlet 103 of the conduit 101 and a second biasing member 121 for urging the piston member 113 away from the outlet 105 of the conduit 101. The first and second biasing members 119, 121 act to urge the piston member 113 into an equilibrium position in the absence of the first and second magnetic fields being generated by the first and second magnetic field generating units 109, 111. In the example of FIG. 1, the first and second biasing members 119, 121 are of approximately equal strength such that the piston member 113 is urged to an equilibrium position located at an approximately equal distance between the first biasing member 119 and the second biasing member 121. The equilibrium position is between the first and second magnetic field generating units 109, 111 and overlaps with facing ends 141, 143 of the first and second magnetic field generating units 109, 111 such that in the equilibrium position the piston member 113 is located within the region 129 (FIG. 2) where the maximum magnetic flux is generated by the first and second magnetic fields. Significantly, this means that the biasing members 119, 121 urge the piston member 113 into a position where the piston member 113 will experience the maximum pulling force from the first and second magnetic fields.

Referring to FIG. 1, the first and second biasing members 119, 121 are magnetic members 119, 121 and in particular are permanent magnets 119, 121 arranged in the form of rings. As an example, the first and second biasing members 119, 121 may be neodymium rings. The first biasing member 119 may have its north pole oriented towards the piston member 113 and the second biasing member 121 may have its south pole oriented towards the piston member 113 or vice versa. Advantageously, using one or more magnetic members 119, 121 simplifies the construction of the electromagnetic pump 100 as fewer movable components are required. The magnetic members 119, 121 are more reliable than the helical springs used in the known electromagnetic pumps 100. This increases the reliability of the electromagnetic pump 100. In addition, helical springs are disadvantageously non-linear and only generally provide sufficient biasing force at the maximum position of the piston member 113 under the alternating power cycle.

Referring to FIGS. 3(*a*)-3(*c*) there is shown an example embodiment of how the first and second magnetic field generating units 109, 111 cooperate with the first and second biasing members 119, 121 to move the piston member 113 through the conduit 101. In this example embodiment, the piston member 113 comprises a permanent magnet. A first end 131 of the piston member 113 forms a north pole and the second end 133 of the piston member 113 forms a south pole. The first biasing member 119 has a north pole facing the first end 131 of the piston member 113 and the second biasing member 121 has a south pole facing the second end 133 of the piston member 113. As an example, the piston member 113 may be formed of neodymium to create the permanent magnet. The piston member 113 may in particular be formed of a ring of neodymium material.

Referring to FIG. 3(*a*) when a voltage of 0V is applied to the first and second magnetic field generating units 109, 111 the piston member 113 is held at an equilibrium position between the first and second biasing members 119, 121 due to the repulsive magnetic forces acting between the piston member 113 and the first and second biasing members 119, 121.

Referring to FIG. 3(*b*) when a positive voltage is applied to the first and second magnetic field generating units 109, 111 the first magnetic field generating unit 109 generates a first magnetic field with a first component having a first direction in the conduit 101. The first magnetic field generating unit 109 is energized to generate a south pole proximate to the equilibrium position and a north pole away from the equilibrium position. The second magnetic field generating unit 111 generates a second magnetic field with a second component having a second direction substantially opposite to the first direction in the conduit 101. The second magnetic field generating unit 111 is energized to generate a south pole proximate to the equilibrium position and a north pole away from the equilibrium position. The first and second magnetic fields generated maximise the magnetic flux and thus the force generated, pulling the piston member 113 towards the inlet 103.

At the central point of the alternating power cycle, the voltage applied to the first and second magnetic field generating units 109, 111 is or approaches 0V. As a result, the piston member 113 is urged back to the equilibrium position due to the action of the first and second biasing members 119, 121.

Referring to FIG. 3(*c*), when a negative voltage is applied to the first and second magnetic field generating units 119, 121 the first magnetic field generating unit 109 generates a first magnetic field with a first component having a first direction in the conduit 101. The first magnetic field generating unit 109 is energized to generate a north pole proximate to the equilibrium position and a south pole away from the equilibrium position. The second magnetic field generating unit 111 generates a second magnetic field with a second component having a second direction in the conduit 101 substantially opposite to the first direction. The second magnetic field generating unit 111 is energized to generate a north pole proximate to the equilibrium position and a south pole away from the equilibrium position. The first and second magnetic fields generated maximise the magnetic flux and thus the force generated, pulling the piston member 113 towards the outlet 105.

It can be appreciated that by repeating the alternating power cycle shown in FIGS. 3(*a*)-3(*c*), the piston member 113 will oscillate within the conduit 101 to pump fluid from the inlet 103 to the outlet 105.

Referring to FIG. 1, the electromagnetic pump 100 comprises a valve member 117 adapted to permit the flow of fluid from the inlet 103 of the conduit 101 to the outlet 105 of the conduit 101 and to restrict the flow of fluid from the outlet 105 of the conduit 101 to the inlet 103 of the conduit 101. In the example embodiment shown in FIG. 1, the valve member 117 is disposed within an internal passageway 115 of the piston member 113. The internal passageway 115 provides a route for fluid from the inlet 103 to the outlet 105. The valve member 117 acts to selectively close the internal passageway 115. The valve member 117 is adapted to move with the piston member 113 through the conduit 101.

It will be appreciated that the present invention is not limited to the particular arrangement shown in the Figures. In particular, the valve member 117 may be movable through the passageway 115 of the piston member 113 under the influence of the first and/or second magnetic fields while the piston member 113 remains stationary or moves with the valve member 117. In this arrangement, the movable valve member 117 effectively acts as the piston member while the piston member 113 effectively acts as the valve member. However, this arrangement may be more inefficient than the arrangement where the piston member 113 moves under the influence of the first and/or second magnetic fields. Other arrangements of piston member 113 and valve member 117 are within the scope of the present invention. Generally, it will be appreciated that the "piston member" is the object that moves under the influence of the first and second magnetic fields to perform the pumping action while the "valve member" cooperates with the piston member to selectively restrict the passage of fluid.

Referring to FIG. 4, the piston member 113 comprises a passageway 115 extending from the first end portion 131 of the piston member 113 to the second end portion 133 of the piston member 113. The valve member 117 is a ball 117 disposed within the passageway 115 of the piston member 113 and is movable or freely movable therein. This provides a simpler valve arrangement to the existing single coil pump by providing fewer components and avoiding the need for a helical spring to control the movement of the valve member. The valve member 117 of the present invention is simpler and more reliable as there are fewer components which may be damaged or fail. The first end portion 131 of the piston member 113 comprises a first obstruction 135 for preventing the valve member 117 from exiting the passageway 115. The first obstruction 135 is a tapering or narrowing section of the passageway 115. The valve member 117 cooperates with the first obstruction 135 to close the passageway 115 at the first end portion 131 to prevent the passage of fluid therethrough. The second end portion 133 comprises a second obstruction 137, 139 adapted to prevent the valve member 117 from exiting the passageway 115 while allowing the passage of fluid therethrough. The second obstruction 137, 139 comprises a stop member 139 in the form of an extending projection 139 and a mesh material 137. The extending projection 139 acts to limit the length of passageway 115 that the valve member 117 may move through. This effectively allows the electromagnetic pump 100 to be driven at higher frequencies as the valve member 117 does not have to travel as far a distance during an alternating power cycle. The extending projection 139 is constructed from a stiff material such as stainless steel or titanium, and may be in the form of a helix. In some arrangements, the extending projection 139 may separately or additionally act to "cup" the valve member 117 when the valve member 117 is not blocking the passageway 115. In these arrangements, the extending projection 139 acts to keep the valve member 117 centred and allow fluid flow around/past the valve member 117.

Referring to FIG. 4, the mesh material 137 is disposed towards the extreme end of the second end portion 133 and acts as an attachment point for the extending projection 139. In other arrangements, the mesh material 137 may be disposed more proximate to the first end portion 131. In such arrangements, the mesh material 137 acts to limit the length of the passageway through which the valve member 117 may move and therefore acts as a stop member. In these arrangements, the extending projection 139 may not be included.

Other forms of obstruction are within the scope of the present invention. In addition, the piston member 113 may have a symmetric appearance such that both end portions 131, 133 of the piston member 113 comprise a first obstruction 135 in the form of a tapering or narrowing section of the passageway 115.

Referring to FIGS. 5(*a*) and 5(*b*), there is shown an example embodiment of how the valve member 117 moves within the passageway 115 to selectively close the passageway 115.

Referring to FIG. 5(*a*) the piston member 113 is being pulled towards the outlet 105. Here, the valve member 117 cooperates with the first obstruction 135 to close the passageway 115. In this way, fluid cannot pass through the passageway 115 in the direction towards the inlet 103 of the conduit 101 and as a consequence fluid is pumped through the outlet 105 due to the movement of the piston member 113 towards the outlet 105.

Referring to FIG. 5(*b*) the piston member 113 is being pulled towards the inlet 103. Here, the valve member 117 is drawn towards the second obstruction 137, 139 leaving the passageway 115 open. In this way, fluid can pass through the passageway 115 from the inlet 103 due to the movement of the piston member 113 towards the inlet.

In some embodiments, the valve member 117 is magnetic or magnetisable. The magnetic or magnetisable valve member 117 is able to move with the pump member 113 under the influence of the first and/or second magnetic field. As the alternating power cycle switches between the first half of the power cycle and the second half of the power cycle, the magnetic or magnetisable valve member 117 is pulled away from one end portion of the piston member 113 towards the other end portion of the piston member 113 such that the valve member performs an automatic or self-sealing function. The movement of the magnetic or magnetisable valve member 117 within the conduit 101 may cause or enhance the movement of the piston member 113 within the conduit 101 under the influence of the first and/or second magnetic field. In some arrangements, the valve member 117 is magnetic or magnetisable and the piston member 113 comprises a non-magnetic or non-magnetisable material. In alternative arrangements, the valve member 117 is magnetic or magnetisable and the piston member is magnetic or magnetisable. The magnetic or magnetisable material used for the valve member 117 may comprise a soft magnetic stainless steel and/or may comprise neodymium.

In other arrangements, the valve member 117 is formed from a non-magnetic material. An example of a non-magnetic material usable for the valve member 117 is zirconium.

Referring to FIG. 1, the first magnetic field generating unit 109 and the second magnetic field generating unit 111 are spaced apart from one another by a relatively short distance such that they are proximate to one another. In particular, the distance between the first and second magnetic field generating units 109, 111 is less than the length of the piston member 113. Advantageously, by having magnetic field generating units 109, 111 proximate to one another, a large (or larger) magnetic flux is generated towards the facing end regions 141, 143 of the first and second magnetic field generating units 109, 111. The first and second magnetic field generating units 109, 111 cooperate to generate this large (or larger) magnetic flux and thus the piston member 113 experiences a greater driving force. The first magnetic field generating unit 109 and the second magnetic field generating unit 111 are sufficiently proximate to one another that a region of large magnetic flux is generated between the first and second magnetic field generating units 109, 111. The first magnetic field generating unit 109 and second magnetic field generating unit 111 are sufficiently proximate to one another that in the equilibrium position, the end portions 131, 133 of the piston member 113 are proximate to the facing end portions 141, 143 of the first and second magnetic field generating units 109,111. This means that in the equilibrium position the piston member 113 will experience the maximum magnetic flux. The piston member 113 is therefore in the optimum position for maximum deflection and as a result the piston member 113 experiences a greater driving force.

Referring to FIG. 6, there is shown another example electromagnetic pump 100. Here, the electromagnetic pump 100 includes the same elements as the electromagnetic pump 100 shown in FIGS. 1-5 except for the obstruction element 139. Instead, the mesh material 137 acts as the obstruction element by itself. In addition, in the electromagnetic pump shown in FIG. 6, the first magnetic field generating unit 109 and the second magnetic field generating unit 111 are further spaced apart from one another than in the arrangement shown in FIGS. 1-5. Here the distance between the first and second magnetic field generating units 109, 111 is approximately the same as the length of the piston member 113. In this arrangement, the magnetic flux generated between the first and second magnetic field generating units 109, 111 will be less than embodiment of FIG. 1. The present invention is not limited to any particular spacing of the first magnetic field generating unit 109 and the second magnetic field generating unit 111. The first and second magnetic field generating units 109, 111 may be spaced far apart or may be very close or even abutting one another. Generally, the most magnetic flux will be generated when the ends 131, 133 of the piston member 113 are close to the facing edge portions 141, 143 of the first and second magnetic field generating units 109, 111.

Referring to FIGS. 1, 2, 3(*a*)-3(*c*), 5(*a*)-5(*b*), 6 and 7, the first magnetic field generating unit 109 comprises a first coil 109. The second magnetic field generating unit 111 comprises a second coil 111. In some arrangements, the first coil 109 and the second coil 111 are driven by separate power supplies. In other arrangements, the first coil 109 has windings disposed in a first winding direction and the second coil 111 has windings disposed in a second winding direction opposite or substantially opposite to the first winding direction. In these arrangements, the first and second coil 109, 111 can be driven by the same power supply. The first coil 109 and/or the second coil 111 surround the circumference of the conduit 101. The first and/or second coils 109, 111 are constructed from copper.

In some example arrangements, the conduit 101 is constructed from a non-magnetic material. An example of the non-magnetic material is non-magnetic stainless steel.

Referring to FIG. 7, the electromagnetic pump 100 comprises an outer housing 151 that surrounds the conduit 101. In some arrangements, the outer housing 151 may be constructed from a non-magnetic material. An example of the non-magnetic material is non-magnetic stainless steel. The outer housing 151 may be constructed from a biocompatible material.

In some arrangements, the electromagnetic pump 100 has a volume of between 1 $cm^3$ and 21 $cm^3$. The electromagnetic pump 100 is able operate over a range of frequencies. The frequencies range from 1 Hz to 120 Hz in some example arrangements. The electromagnetic pump 100 is able operate over a range of input powers. The input powers range from 0.1 W to 10 W in some example arrangements.

Micropump

The electromagnetic pump 100 is suitable for use as an electromagnetic micropump 100. Micropumps have pumping characteristics which enable them to be used in microfluidics. Microfludics is a diverse application that is used in a wide array of industries, including the microelectronics, aerospace, telecommunications, biomedical and pharmaceutical sectors. A critical issue that is holding back development of the microfluidic industry is the lack of efficient, reliable pumping. Known existing micropumps have time to failures of approximately 5000 to 10000 hours, irrespective of the driving technology. This level of reliability is insufficient for most micropump applications especially those related to the biomedical and pharmaceutical sectors.

The electromagnetic micropump 100 of the present invention has overcome the problem of low reliability present in existing micropump technologies. This is due to the advantageous structure of the electromagnetic micropump 100 of the present invention, for example due to the limited number of moving parts; the absence of diaphragm members; and the efficient use of two magnetic field generating units 109, 111 to drive the piston member 113 within the conduit 101. Further, the electromagnetic micropump 100 is self-priming and can operate at high temperatures (e.g. greater than 100 degrees Centigrade). Here, self-priming means that the electromagnetic micropump 100 can pump air as well as liquid, and thus can draw the liquid into itself when not full with fluid. Some existing known micropumps need to have liquid pulled (or pushed) through them in order to work because they cannot pump air. This self-priming property is also applicable to the general electromagnetic pump 100 of the present invention.

In one example, the electromagnetic micropump 100 provides high pressure-flow characteristics of approximately 50 ml/min at 35 kPa pressure, and in another example is able to prove high pressure-flow characteristics of approximately 200 ml/min at 50 kPa at a low power consumption of approximately less than 1 W and a small physical size of between 1 and 4 $cm^3$. In addition, the electromagnetic micropump 100 is able to achieve high flow rates of up to 98 ml/min at 1 W input power. In one example, this high flow rate is more than is required for most existing biomedical applications.

The electromagnetic micropump 100 is able to operate in a closed loop—which is not available in existing micropumps which operate using solenoids or diaphragms. These existing pumps can change volume which is generally acceptable in an open loop system, but in a closed loop system it is generally not acceptable as there is nowhere for the fluid to go. The closed loop operating property is also applicable to the general electromagnetic pump 100 of the present invention.

Referring to FIGS. 8(*a*)-8(*d*) there are shown the pumping characteristics according to one example electromagnetic micropump 100. These pumping characteristics are just to highlight the advantageous properties that can be achieved by the electromagnetic pump 100 of the present invention. It will be appreciated that different pumping characteristics will be achieved based on, for example, the volume of the electromagnetic pump 100.

Referring to FIG. 8(*a*) it can be seen how the flow rate of the example electromagnetic micropump 100 varies as a function of the driving frequency at 1 W input power. In this example, the maximum flow rate is achieved at approximately 15 Hz, and an upper limiting frequency of ~120 Hz exists before significant reduction occurs. The lower drop off is due to the pump length and magnetic springs 119, 121, and the upper limits is due to the maximum switching capacity of the valve member 117.

Referring to FIG. 8(*b*) it can be seen that the maximum flow rate of the example electromagnetic micropump 100 varies as a function of the input power.

Referring to FIG. 8(*c*) it can be seen how the pressure-flow characteristics of the example electromagnetic micropump 100 vary over a range of input powers up to 2 W. The pressure-flow characteristics are consistent in form over the range of input powers. At 0.5 W, a maximum flow rate of 48 ml/min and a pressure of 30 kPa is achieved; this increases (non-linearly) with power, with 86 ml/min and 37 kPa developed at 2 W.

Referring to FIG. 8(*d*) it can be seen how the flow rate varies as a function of time at 0.5 W input power over a 12 hour period without stabilization feedback. Over this period, the flow rate varies by about 2.5 ml/min—demonstrating good stability.

From FIGS. 8(*a*)-8(*d*) it can be appreciated that the example electromagnetic pump 100 has characteristics suitable for microfluidic applications.

For the electromagnetic micropump 100 which generated the results shown in FIGS. 8(*a*)-8(*d*), the conduit 101 is approximately 40 mm long and has an internal diameter of 6.35 mm and an external diameter of 12.5 mm. The first windings of the first coil 109 and the second coil 111 have a diameter of approximately 0.12 mm. The internal passageway 115 of the piston member 113 has a diameter of approximately 3.12 mm. The present invention is not limited to any particular dimensions of components.

Method of Operation

Referring to FIG. 9 there is shown an example operation of the electromagnetic pump 100 to pump fluid through the conduit 101.

At S201 the first magnetic field generating unit 109 is driven to generate a first magnetic field, the first magnetic field having a first component with a first direction in the conduit 101.

At S202 the second magnetic field generating unit 111 is driven to generate a second magnetic field, the second magnetic field having a second component with a second direction in the conduit 101, the second direction being substantially opposite to the first direction. The first and/or second magnetic fields generated at S201 and S202 move the piston member 113 within the conduit 101 to pump fluid through the conduit 101.

S201 and S202 may be performed simultaneously such that the first and second magnetic field generating units 109, 111 are simultaneously driven to generate the first and second magnetic fields.

In S201 and S202, the first and second magnetic field generating units 109, 111 may be driven under one or more alternating power cycles to periodically reverse the direction of the magnetic fields generated by the first and second magnetic field generating units 109, 111. During a first portion of the one or more alternating power cycles, the first and second magnetic field generating units 109, 111 direct the first component of the first magnetic field and the second component of the second magnetic field towards one another. During a second portion of the one or more alternating power cycles, the first and second magnetic field generating units 109, 111 direct the first component of the first magnetic field and the second component of the second magnetic field away from one another.

Referring to FIG. 10 there is shown another example electromagnetic pump 1000 in accordance with the present invention. The electromagnetic pump 1000 operates in the same way as the electromagnetic pumps of the present invention described above. The electromagnetic pump 1000 comprises a titanium conduit/housing 101. The first and second magnetic field generating units 1009, 1011 are in the form of copper coils. The piston member 1013 is constructed from neodymium. At the end portions of the piston member 1013 there are titanium fitting members 1101, 1103 with neodymium end portions 1031, 1033 attached thereto. Within the passageway 1015 of the piston member 1013, there is a valve member 1017 in the form of a ball 1017 constructed of Viton. At least the fitting member 1101 acts as an obstruction to prevent the ball 1017 leaving the piston member 1013. The piston member 1013 further comprises another obstruction member 1039 in the form of a helix constructed from titanium to reduce the distance by which the ball 1017 can move within the passageway 1015. The inlet 1003 and the outlet 1005 of the conduit 1001 comprise titanium fittings and have neodymium magnetic members 1019, 1021 which act to bias the piston member 1013 away from the ends of the conduit 1001.

In this example, the electromagnetic pump 1000 is a micropump 1000. The length of the electromagnetic pump 1000 is 19 mm. The internal diameter of the conduit 1001 is 5 mm. The separation between the coils 1009, 1011 is 1 mm. The coils are 8 mm in length. The passageway 1015 has an internal diameter of 3.17 mm. The titanium fitting members 1101, 1103 have an internal diameter of 2 mm. The ball 1017 has a diameter of 2.3 mm. There is a 1 mm separation between the ends of the coils 1009, 1011 and the ends of the conduit 1001.

Referring to FIGS. 11(*a*)-11(*b*) there are shown the pumping characteristics according to one example electromagnetic micropump 1000. These pumping characteristics are just to highlight the advantageous properties that can be achieved by the electromagnetic pump 1000 of the present invention. It will be appreciated that different pumping characteristics will be achieved based on, for example, the volume of the electromagnetic pump 1000.

Referring to FIG. 11(*b*) it can be seen how the flow rate of the example electromagnetic micropump 1000 varies as a function of the pressure at different power inputs.

Referring to FIG. 11(*b*) it can be seen how the flow rate and the pressure of the electromagnetic micropump 1000 vary as a function of the input power.

From FIGS. 11(*a*)-11(*b*) it can be appreciated that the example electromagnetic pump 100 has characteristics suitable for microfluidic applications.

Although a few preferred embodiments of the present invention have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An electromagnetic pump comprising:

a conduit comprising an inlet and an outlet;

a first magnetic field generating unit for generating a first magnetic field having a first component with a first direction in the conduit;

a second magnetic field generating unit for generating a second magnetic field having a second component with a second direction in the conduit, the second direction being substantially opposite to the first direction;

a piston member disposed within the conduit, the piston member being moveable within the conduit under the influence of at least one of the first and second magnetic fields to pump fluid received from the inlet of the conduit to the outlet of the conduit;

the electromagnetic pump further comprising one or more biasing means for urging the piston member away from one or both of the inlet and the outlet of the conduit and into an equilibrium position between the first magnetic field generating unit and second magnetic field generating unit, wherein the biasing means comprise one or more magnetic members; and the first magnetic field generating unit and the second magnetic field generating unit being sufficiently proximate to one another that in the equilibrium position, the end portions of the piston member are proximate to the facing end portions of the first and second magnetic field generating units.

2. An electromagnetic pump as claimed in claim 1, wherein the first and second magnetic field generating units are adapted to be simultaneously driven to generate the first and second magnetic fields.

3. An electromagnetic pump as claimed in claim 1, wherein the first and second magnetic field generating units are adapted to be driven under one or more alternating power cycles to periodically reverse the direction of the magnetic fields generated by the first and second magnetic field generating units.

4. An electromagnetic pump as claimed in claim 3, wherein during a first portion of the one or more alternating power cycles, the first and second magnetic field generating units are adapted to direct the first component of the first magnetic field and the second component of the second magnetic field towards one another, and/or during a second portion of the one or more alternating power cycles, the first and second magnetic field generating units are adapted to direct the first component of the first magnetic field and the second component of the second magnetic field away from one another.

5. An electromagnetic pump as claimed in claim 1, further comprising a valve member adapted to permit the flow of fluid from the inlet of the conduit to the outlet of the conduit and to restrict the flow of fluid from the outlet of the conduit to the inlet of the conduit.

6. An electromagnetic pump as claimed in claim 5, wherein the valve member is adapted to move with the piston member through the conduit.

7. An electromagnetic pump as claimed in claim 5, wherein the piston member comprises a passageway extending therethrough, and the valve member is disposed at least partially within the passageway of the piston member.

8. An electromagnetic pump as claimed in claim 1, wherein the first magnetic field generating unit and the second magnetic field generating unit are spaced apart from one another such that a first region of the conduit is disposed between the first and second magnetic field generating units.

9. An electromagnetic pump as claimed in claim 1, wherein the first magnetic field generating unit comprises a first coil and the second magnetic field generating unit comprises a second coil.

10. An electromagnetic pump as claimed in claim 9, wherein the first coil has windings disposed in a first winding direction and the second coil has windings disposed in a second winding direction opposite to the first winding direction.

11. An electromagnetic pump as claimed in claim 9, wherein the first coil and/or the second coil surround the conduit.

12. An electromagnetic pump as claimed in claim 1, wherein the piston member comprises a magnetic or magnetisable member.

13. A method for pumping fluid through a conduit having a piston member disposed therein, the method comprising:

driving a first magnetic field generating unit to generate a first magnetic field, the first magnetic field having a first component with a first direction in the conduit;

driving a second magnetic field generating unit to generate a second magnetic field, the second magnetic field having a second component with a second direction in the conduit, the second direction being substantially opposite to the first direction, wherein the first and/or second magnetic fields move the piston member within the conduit to pump fluid through the conduit;

wherein the method comprises using an electromagnetic pump comprising:

the conduit, the conduit comprising an inlet and an outlet;

the first magnetic field generating unit, the first magnetic field generating unit being for generating the first magnetic field having the first component with the first direction in the conduit;

the second magnetic field generating unit, the second magnetic field generating unit being for generating the second magnetic field having the second component with the second direction in the conduit, the second direction being substantially opposite to the first direction;

the piston member, the piston member being disposed within the conduit, the piston member being moveable within the conduit under the influence of at least one of the first and second magnetic fields to pump fluid received from the inlet of the conduit to the outlet of the conduit;

the electromagnetic pump further comprising one or more biasing means for urging the piston member away from one or both of the inlet and the outlet of the conduit and into an equilibrium position between the first magnetic field generating unit and second magnetic field generating unit, wherein the biasing means comprise one or more magnetic members; and the first magnetic field generating unit and the second magnetic field generating unit being sufficiently proximate to one another that in the equilibrium position, the end portions of the piston member are proximate to the facing end portions of the first and second magnetic field generating units.

* * * * *